US008684696B2

(12) United States Patent
Ress, Jr.

(10) Patent No.: US 8,684,696 B2
(45) Date of Patent: Apr. 1, 2014

(54) GAS TURBINE ENGINE AND MAIN ENGINE ROTOR ASSEMBLY AND DISASSEMBLY

(75) Inventor: Robert A. Ress, Jr., Carmel, IN (US)

(73) Assignee: Rolls-Royce North American Technologies, Inc., Indianapolis, IN (US)

( * ) Notice: Subject to any disclaimer, the term of this patent is extended or adjusted under 35 U.S.C. 154(b) by 722 days.

(21) Appl. No.: 12/889,005

(22) Filed: Sep. 23, 2010

(65) Prior Publication Data

US 2012/0076657 A1 Mar. 29, 2012

Related U.S. Application Data

(60) Provisional application No. 61/291,656, filed on Dec. 31, 2009.

(51) Int. Cl.
*F04D 29/043* (2006.01)

(52) U.S. Cl.
USPC ..... 416/198 A

(58) Field of Classification Search
USPC ..... 416/198 A, 198 R, 204 R, 212 R, 212 A; 415/122.1, 124.1, 124.2, 216.1; 464/182; 403/315, 316, 319
See application file for complete search history.

(56) References Cited

U.S. PATENT DOCUMENTS

| | | | | |
|---|---|---|---|---|
| 2,803,397 | A * | 8/1957 | Gardiner | 416/244 R |
| 2,977,758 | A * | 4/1961 | Haworth et al. | 60/796 |
| 3,336,974 | A * | 8/1967 | Bernstein et al. | 165/158 |
| 3,467,419 | A | 9/1969 | Anderson et al. | |
| 3,679,033 | A | 7/1972 | Wagner | |
| 4,304,523 | A | 12/1981 | Corsmeier et al. | |
| 4,353,685 | A | 10/1982 | Osborn et al. | |
| 4,836,750 | A | 6/1989 | Modafferi et al. | |
| 4,915,589 | A | 4/1990 | Gessler et al. | |
| 5,160,149 | A | 11/1992 | Winn | |
| 5,172,918 | A * | 12/1992 | Pecht et al. | 277/400 |
| 5,255,993 | A * | 10/1993 | Kovacs | 403/328 |
| 5,536,144 | A | 7/1996 | Bednarz et al. | |
| 5,685,650 | A | 11/1997 | Martinie et al. | |
| 6,254,349 | B1 | 7/2001 | Haugen et al. | |
| 6,481,917 | B1 * | 11/2002 | Chen et al. | 403/374.3 |
| 6,499,969 | B1 | 12/2002 | Tombers et al. | |
| 6,626,581 | B2 * | 9/2003 | Uchman | 384/544 |
| 7,540,713 | B1 * | 6/2009 | Marussich | 416/198 A |
| 2003/0133785 | A1 | 7/2003 | Fonda-Bonardi | |
| 2004/0057834 | A1 | 3/2004 | Shimizu | |
| 2005/0013696 | A1 | 1/2005 | Le Jeune et al. | |

(Continued)

OTHER PUBLICATIONS

International Search Report and Written Opinion, PCT/US2010/062493, Rolls-Royce North American Technologies, Inc., Nov. 25, 2011.

(Continued)

*Primary Examiner* — Nathaniel Wiehe
*Assistant Examiner* — Aaron Jagoda
(74) *Attorney, Agent, or Firm* — Krieg DeVault, LLP

(57) ABSTRACT

One embodiment of the present invention is a unique gas turbine engine. Another embodiment is a unique gas turbine engine main engine rotor. Still another embodiment is a unique method for assembling a gas turbine engine main engine rotor. Other embodiments include apparatuses, systems, devices, hardware, methods, and combinations for gas turbine engines and gas turbine rotors. Further embodiments, forms, features, aspects, benefits, and advantages of the present application shall become apparent from the description and figures provided herewith.

20 Claims, 5 Drawing Sheets

(56) References Cited

U.S. PATENT DOCUMENTS

2006/0233479 A1 10/2006 Bouiller et al.
2007/0256412 A1* 11/2007 Martin et al. ..... 60/605.1
2007/0286733 A1* 12/2007 Bouchard ..... 416/204 R
2009/0297083 A1 12/2009 Raberin et al.

OTHER PUBLICATIONS

Extended European Search Report, Rolls-Royce North American Technologies Inc., Jun. 18, 2013.

* cited by examiner

GAS TURBINE ENGINE AND MAIN ENGINE ROTOR ASSEMBLY AND DISASSEMBLY

CROSS REFERENCE TO RELATED APPLICATIONS

The present application claims priority to U.S. Provisional Patent Application No. 61/201,656, filed Dec. 31, 2009, which is incorporated herein by reference.

FIELD OF THE INVENTION

The present invention relates to gas turbine engines, and more particularly, to gas turbine engine rotors and the assembly and disassembly of gas turbine engine rotors.

BACKGROUND

Gas turbine engine rotors remain an area of interest. Some existing systems have various shortcomings, drawbacks, and disadvantages relative to certain applications. Accordingly, there remains a need for further contributions in this area of technology.

SUMMARY

One embodiment of the present invention is a unique gas turbine engine. Another embodiment is a unique gas turbine engine main engine rotor. Still another embodiment is a unique method for assembling a gas turbine engine main engine rotor. Other embodiments include apparatuses, systems, devices, hardware, methods, and combinations for gas turbine engines and gas turbine engine rotor assemblies. Further embodiments, forms, features, aspects, benefits, and advantages of the present application shall become apparent from the description and figures provided herewith.

BRIEF DESCRIPTION OF THE DRAWINGS

The description herein makes reference to the accompanying drawings wherein like reference numerals refer to like parts throughout the several views, and wherein.

DETAILED DESCRIPTION

Figure 1:
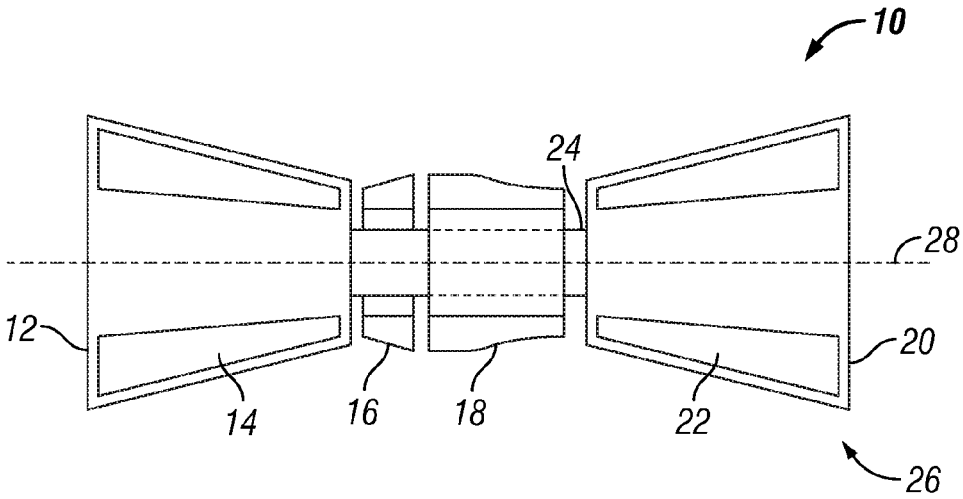
FIG. 1 schematically illustrates a non-limiting example of a gas turbine engine in accordance with an embodiment of the present invention.

For purposes of promoting an understanding of the principles of the invention, reference will now be made to the embodiments illustrated in the drawings, and specific language will be used to describe the same. It will nonetheless be understood that no limitation of the scope of the invention is intended by the illustration and description of certain embodiments of the invention. In addition, any alterations and/or modifications of the illustrated and/or described embodiment(s) are contemplated as being within the scope of the present invention. Further, any other applications of the principles of the invention, as illustrated and/or described herein, as would normally occur to one skilled in the art to which the invention pertains, are contemplated as being within the scope of the present invention.

Referring now to the drawings, and in particular, FIG. 1, a non-limiting example of a gas turbine engine 10 in accordance with an embodiment of the present invention is schematically depicted. In one form, gas turbine engine 10 is an axial flow machine, e.g., an air-vehicle power plant. In other embodiments, gas turbine engine 10 may be a radial flow machine or a combination axial-radial flow machine. Embodiments of the present invention include various gas turbine engine configurations, for example, including turbojet engines, turbofan engines, turboprop engines, and turboshaft engines having axial, centrifugal and/or axi-centrifugal compressors and/or turbines.

In one form, gas turbine engine 10 includes a compressor 12 having a compressor rotor 14; a diffuser 16; a combustion system 18; a turbine 20 having a turbine rotor 22; and a shaft 24 coupling compressor rotor 14 with turbine rotor 22. Combustion system 18 is in fluid communication with compressor 12 and turbine 20. Turbine rotor 22 is drivingly coupled to compressor rotor 14 via shaft 24. Compressor rotor 14, turbine rotor 22 and shaft 24 form a main engine rotor 26, which rotates about an engine centerline 28. Although only a single spool is depicted, it will be understood that embodiments of the present invention include both single-spool and multi-spool engines. The number of blades and vanes, and the number of stages thereof of compressor 12 and turbine 20 may vary with the application, e.g., the efficiency and power output requirements of a particular installation of gas turbine engine 10. In various embodiments, gas turbine engine 10 may include one or more fans, additional compressors and/or additional turbines.

During the operation of gas turbine engine 10, air is received at the inlet of compressor 12 and compressed. After having been compressed, the air is supplied to diffuser 16, which reduces the velocity of the pressurized air discharged from compressor 12. The pressurized air exiting diffuser 16 is mixed with fuel and combusted in combustion system 18. The hot gases exiting combustion system 18 are directed into turbine 20. Turbine 20 extracts energy from the hot gases to, among other things, generate mechanical shaft power to drive compressor 12 via shaft 24. In one form, the hot gases exiting turbine 20 are directed into a nozzle (not shown), which provides thrust output for gas turbine engine 10. In other embodiments, additional compressor and/or turbine stages in one or more additional rotors upstream and/or downstream of compressor 12 and/or turbine 20 may be employed, e.g., in single or multi-spool gas turbine engines.

Figure 2:
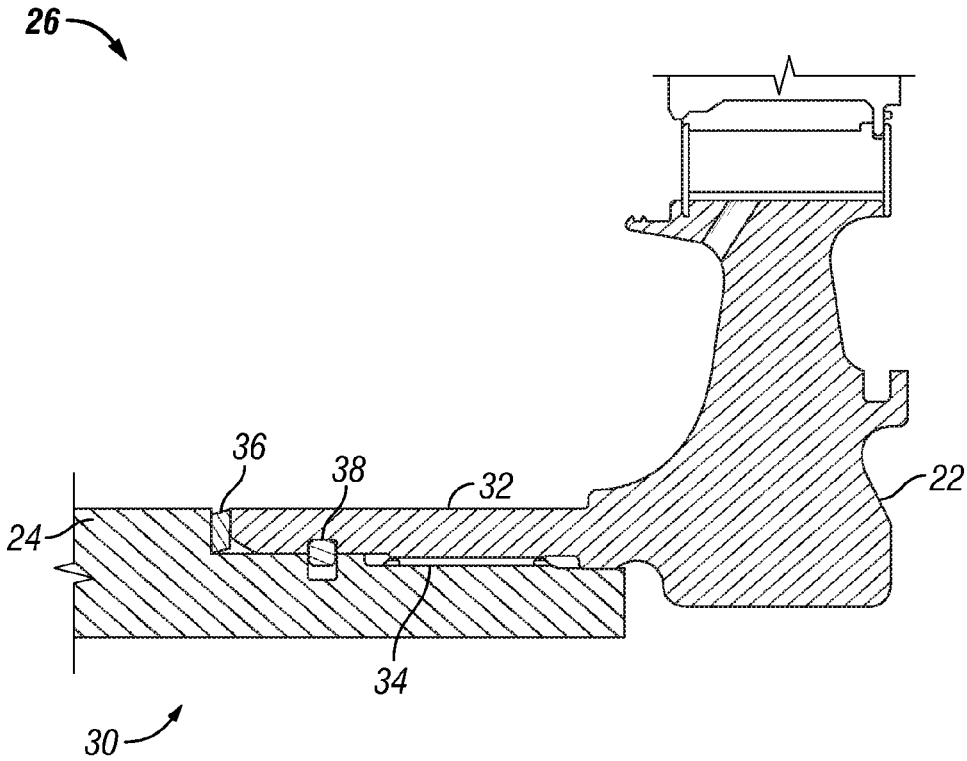
FIG. 2 schematically illustrates aspects of a non-limiting example of a gas turbine engine rotor and a non-limiting example of a system for clamping rotor components together in accordance with an embodiment of the present invention.

Referring now to FIG. 2, a non-limiting example of a system 30 for clamping together components of main engine rotor 26 is schematically depicted in accordance with an embodiment of the present invention. In the present example, turbine rotor 22 includes a stub shaft 32. In other embodiments, stub shaft 32 may be formed separately and affixed to turbine rotor 22. System 30 is operative to clamp shaft 24 and stub shaft 32. In one form, stub shaft 32 is integral with turbine rotor 22. System 30 retains turbine rotor 22 and shaft 24 in a coupled arrangement. A splined interface 34 between stub shaft 32 and shaft 24 transmits torque between turbine rotor 22 and shaft 24.

System 30 includes a compression washer 36 and a retaining ring 38 positioned in such a way that a preload is maintained between the turbine rotor 22 and shaft 24 during engine 10 operation. The preload is maintained by compression washer 36, which is placed into a state of compression during the assembly of turbine rotor 22 and shaft 24. Use of the term, "compression" in the present context indicates that compression washer 36 is compressed in the sense that a spring is compressed, and is not necessarily reflective of the stress field within compression washer 36. In one form, compression washer 36 is a conical compression washer, otherwise known as, for example, a Bellville spring, a Bellville washer or a disk spring. It will be understood that the shape of compression washer 36 is not limited to being conical; rather, any suitable shape may be employed in various embodiments. In one form, retaining ring 38 is a split retaining ring. In other embodiments, other retaining ring types may be employed, for example, spiral retaining rings.

Figure 3:
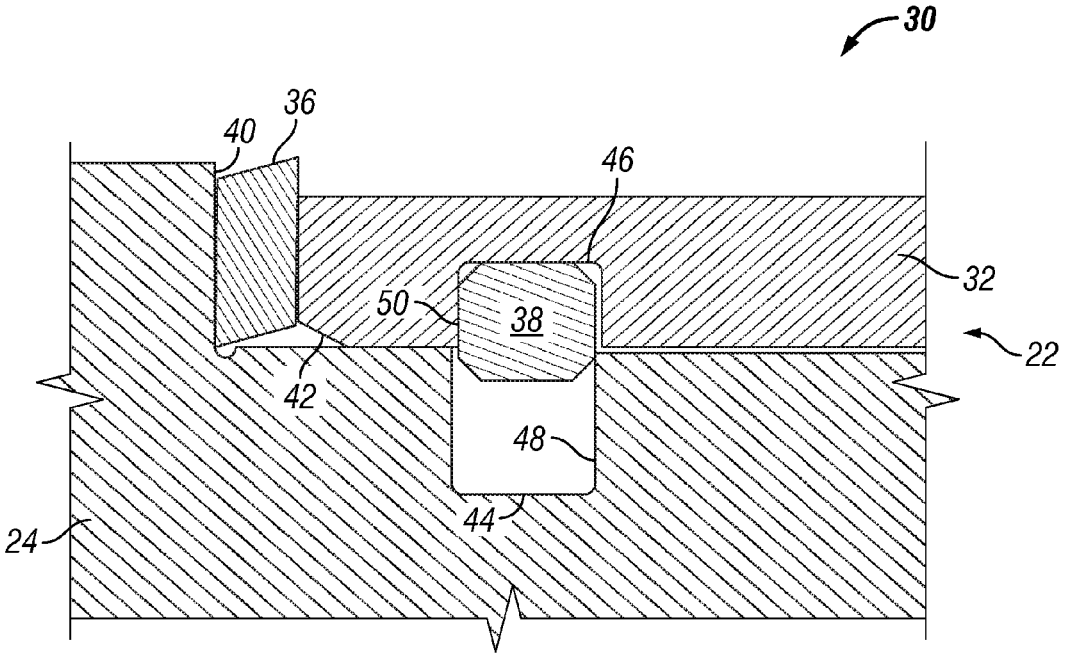
FIG. 3 is an enlarged view illustrating some features of the system of FIG. 2.

Referring now to FIG. 3, an enlarged view of system 30 is depicted with turbine rotor 22 and shaft 24 in the assembled state. Each component of rotor 26 that is clamped together with system 30 includes a face through which loads to/from compression washer 36 are transferred into the component. In the depicted example, shaft 24 includes a face 40, and stub shaft 32 of turbine rotor 22 includes a face 42 opposite face 40, through which loads to and from compression washer 36 are transferred into the respective shaft 24 and turbine rotor 22. Compression washer 36 mechanically loads face 40 against face 42. In some embodiments, an intervening component, such as a spacer or another component, may be placed between compression washer 36 and either or both of face 40 and face 42.

Each component of rotor 26 that is clamped together with system 30 also includes another face for reacting the compression washer 36 loads with retaining ring 38. In one form, the other face is part of an opening in each component that receives therein retaining ring 38. In the depicted example, shaft 24 includes a shouldered channel 44, and stub shaft 32 includes a shouldered channel 46. Channels 44 and 46 are configured to receive retaining ring 38. In one form, channels 44 and 46 extend circumferentially around a respective inside or outside diameter of each component. In one example, the channels are circumferentially continuous. In other embodiments, discontinuous or interrupted channels may be employed. In one form, channel 44 is a groove, e.g., a circumferential slot, and channel 46 is also a groove. Groove 44 includes a face 48, and groove 46 includes a face 50 that faces opposite face 48. Faces 48 and 50 react the compression washer 36 loads through retaining ring 38, which loads retaining ring 38 in shear. Faces 40 and 42, and grooves 44 and 46, or more particularly, faces 48 and 50 of respective grooves 44 and 46, are positioned so that compression washer 36 is in a state of compression between face 40 and face 42 when retaining ring 38 is positioned in both groove 44 and groove 46, or more particularly, when retaining ring 38 is positioned between faces 48 and 50. In other embodiments, other types of channels in addition to or in place of grooves may be employed, so long as those channels include opposing faces such as faces 48 and 50 to react the compression washer 36 loads through retaining ring 38.

In one form, at assembly, retaining ring 38 is displaced inward into groove 44, and once assembled, retaining ring 38 is displaced radially outward and expanded into groove 46, which locks shaft 24 and turbine rotor 22 together axially. Faces 40 and 42, and compression washer 36 are positioned such that when retaining ring 38 is in the expanded state, occupying both grooves 44 and 46 between faces 48 and 50, conical compression washer 36 is in a compressed state. Loads from the compressed compression washer 36 tend to drive shaft 24 and turbine rotor 22 axially apart, which is prevented by retaining ring 38. In one form, the force exerted by compression washer 36 is selected to provide a preload on the mated components during all operating conditions of engine 10. The force is based primarily on the spring characteristics of compression washer 36, the axial dimensions of compression washer 36 and retaining ring 38, and the locations of faces 40, 42, 48 and 50. In other embodiments, the force exerted by compression washer 36 may be selected to maintain a preload only under some engine 10 operating conditions.

Figure 4:
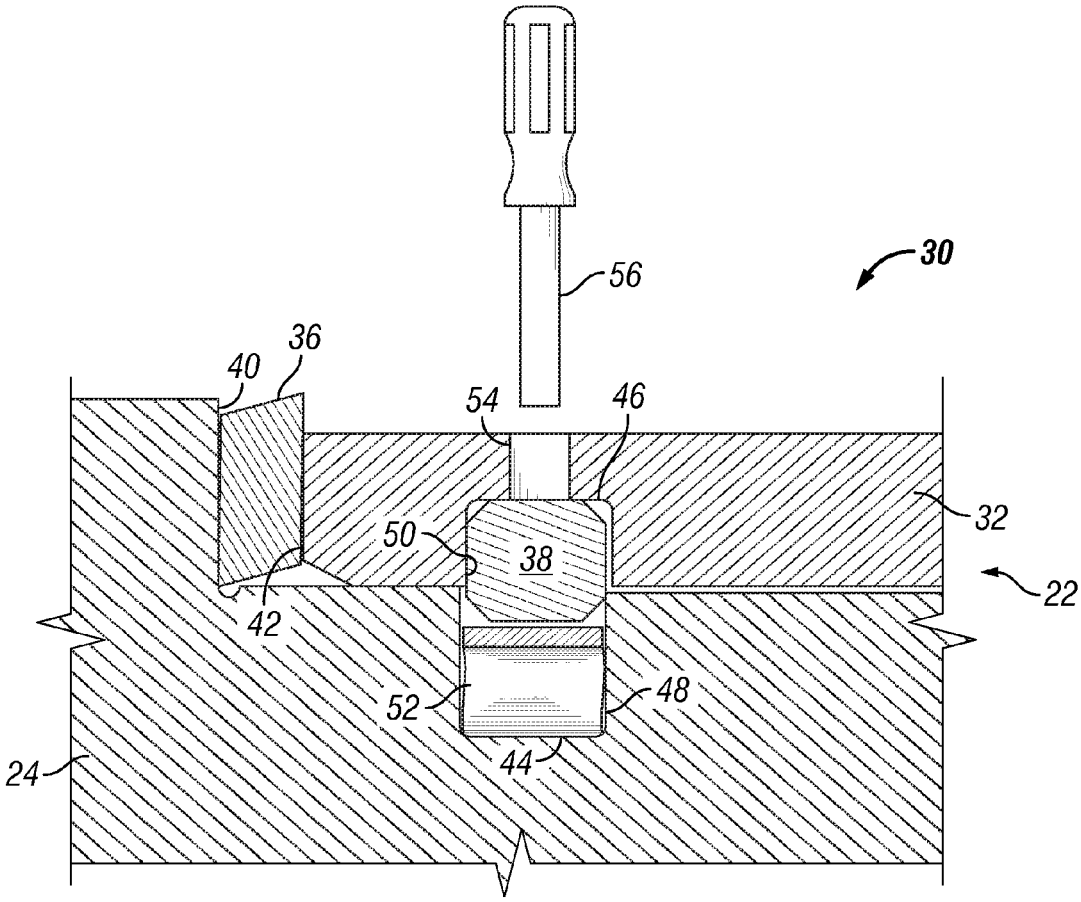
FIG. 4 schematically illustrates a non-limiting example of additional features that may be employed in embodiments of the present invention.

Referring now to FIG. 4, a non-limiting example of some additional features that may be included in various embodiments of system 30 is depicted. Additional features may include, for example, a spring 52 disposed adjacent to retaining ring 38. Spring 52 is operative to provide a load to retaining ring 38 in order to assist retaining ring 38 in expanding from groove 44 into groove 46. In other embodiments, spring 52 may be operative to assist retaining ring in collapsing from groove 46 into groove 44. In one form, spring 52 is a circumferential wave washer. In other embodiments, other types of springs may be employed.

Additional features may also include one or more openings in one or both components of rotor 26 to facilitate the assembly and/or disassembly of rotor 26 components. In the embodiment of FIG. 4, stub shaft 32 of turbine rotor 22 includes a plurality of openings in the form of holes 54. Holes 54 are configured to receive a tool 56, such as one or more tooling pins. Tool 56 may be used to compress retaining ring 38 (and spring 52 for those embodiments that employ spring 52) so that turbine rotor 22 may be removed from shaft 24. In other embodiments, shaft 24 may include openings such as holes 54 to aid in expanding retaining ring 38 using a tool such as tool 56. In various embodiments, either or both components of rotor 26 may include openings such as holes 54 to aid in compressing and/or expanding retaining ring 38 to aid in the assembly and/or disassembly of rotor 26.

The assembly and disassembly of rotor components such as turbine rotor 22 and shaft 24 may be accomplished in more than one manner. In one form, assembly may include positioning compression washer 36 between face 40 of shaft 24 and face 42 of stub shaft 32 of turbine rotor 22; positioning retaining ring 38 in groove 44; assembling stub shaft 32 of turbine rotor 22 onto shaft 24; applying a clamp load to force compression washer 36 into a state of compression between face 40 of shaft 24 and face 42 of stub shaft 32 of turbine rotor 22; and displacing retaining ring 38 so that retaining ring 38 is positioned in both grooves 44 and 46. The displacement of retaining ring 38 may include self-displacement from a compressed state, and/or forced displacement. Other assembly steps in addition to or in place of those described herein may likewise be employed.

Disassembly of turbine rotor 22 from shaft 24 may be performed by repositioning retaining ring 38 from being in both groove 44 and groove 46 to being in only one of groove 44 and groove 46, and by removing sliding turbine rotor 22 off of shaft 24. In the illustrated embodiment, retaining ring 38 is displaced from groove 46 into groove 44 in order to disassemble rotor 36. In other embodiments, retaining ring 38 may be displaced from groove 44 into groove 46 in order to disassembly rotor 36. In either case, a tool such as tool 56 may be inserted into an opening such as hole 54 and be used to apply force to retaining ring 38 in order to displace retaining ring 38 to disassemble rotor 36.

Figure 5:
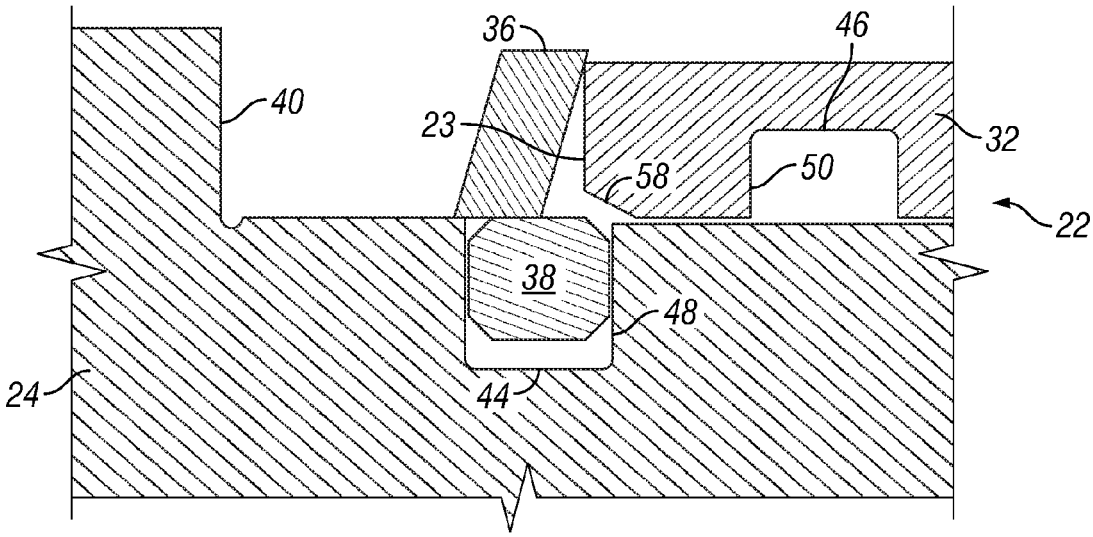
FIG. 5 schematically illustrates aspects of the gas turbine engine rotor and system of FIG. 2 in a state of partial assembly.

Referring now to FIG. 5, a convenient method of assembling turbine rotor 22 and shaft 24 is described. In one form, assembly is accomplished by first installing retaining ring 38 in groove 44 in shaft 24. Next, retaining ring 38 is compressed, and compression washer 36 is installed atop retaining ring 38. This displaces the retaining ring 38 into groove 44, and allows the forward edge of stub shaft 32 to pass over retaining ring 38. In some embodiments, stub shaft 32 is heated to expand the pilot diameters thereby eliminating any interference at the mating surfaces. Likewise, in some embodiments shaft 24 is cooled. Stub shaft 32 is then slid onto shaft 24, engaging drive splines 34. As turbine rotor 22 is further engaged, the forward edge of the stub shaft 32 displaces compression washer 36 off of retaining ring 38. A chamfer 58 on the inner edge of stub shaft 32 allows stub shaft 32 to pass smoothly over retaining ring 38. An axial clamping load is then applied between turbine rotor 22 and shaft 24, rotor displacing compression washer 36 until groove 46 in stub shaft 32 shaft aligns with retaining ring 38. With the components thus aligned, retaining ring 38 expands outward into groove 46 of stub shaft 32. The assembly of shaft 24 and turbine rotor 22 is now complete. In embodiments that employ spring 52, spring 52 assists retaining ring 38 in expanding into groove 46. In some embodiments, no special tooling is required to join the mating parts.

Disassembly is accomplished by first applying an axial clamp load to the mated components such that the preload is removed from retaining ring 38. Tool 56 is then employed via holes 54 to reposition retaining ring 38 out of groove 46 and further into groove 44. Displacing retaining ring 38 inward with the tooling pins allows stub shaft 32 to disengage from shaft 24. In other embodiments, other types of tools may be employed to disassemble rotor 26.

In the depiction of FIGS. 2-5 aspects of the present invention are illustrated and described relative to assembling a shaft to a rotor. Embodiments of the present invention are equally applicable to other rotor assembly configurations, such as for clamping together rotor disks and/or spacers of a turbine rotor or compressor rotor.

Figure 6A:
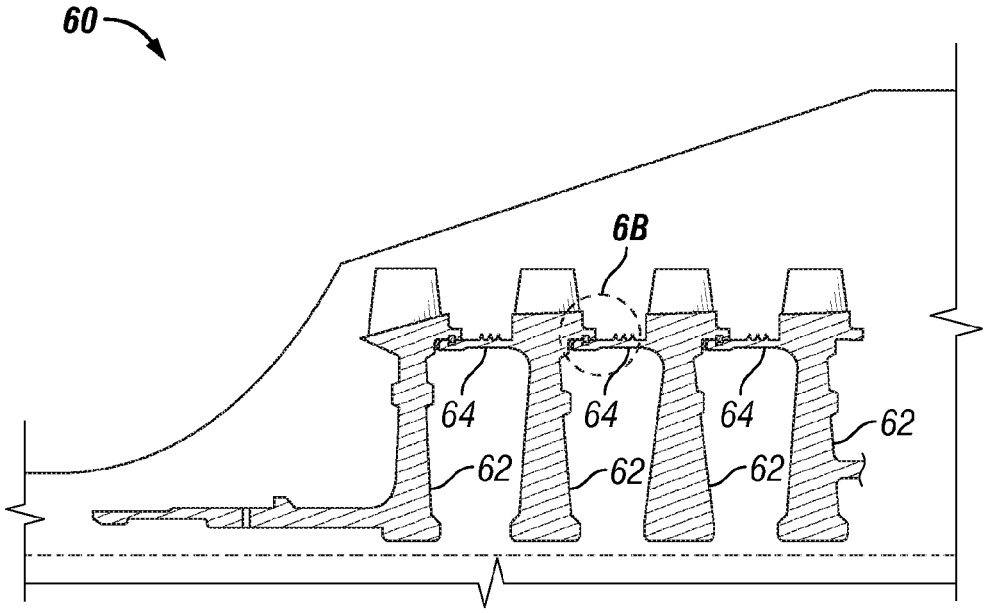
FIGS. 6A and 6B schematically illustrate aspects of a non-limiting example of a gas turbine engine rotor and a non-limiting example of a system for clamping rotor components together.
Figure 6B:
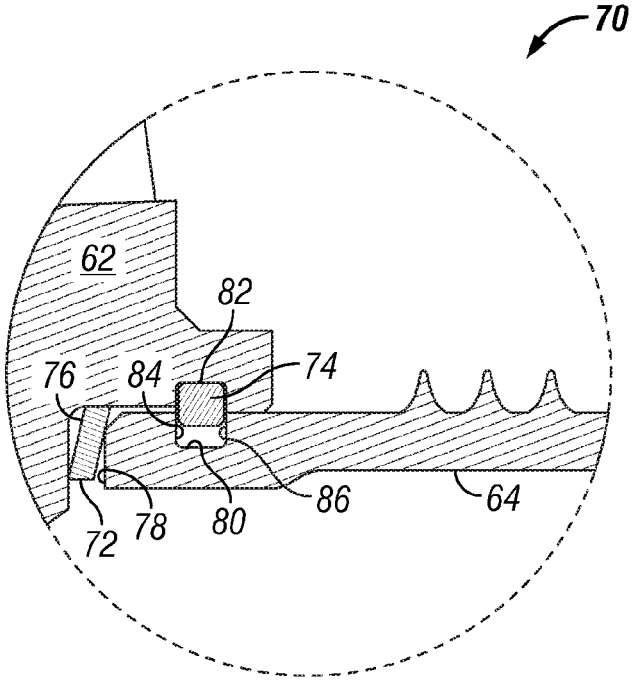

For example, referring now to FIGS. 6A and 6B, a non-limiting example of a four stage compressor rotor 60 in accordance with an embodiment of the present invention is depicted. Rotor 60 includes four disks 62, three of which include an integral spacer 64. In other embodiments, spacers 64 may be separately formed and attached to disks 62 using any convenient method, such as that described herein. In the embodiment of FIGS. 6A and 6B, a system 70 for clamping components of compressor rotor 60 together includes a compression washer 72 and a retaining ring 74.

Similar to the embodiments described in FIG. 2-5, compression washer 72 is disposed between opposite faces 76 and 78 of the mating adjacent components; and retaining ring 74 is disposed in opposite channels 80 and 82 with opposite faces 84 and 86. As with the embodiment of FIGS. 2-5, compression washer 72 and a retaining ring 74 are positioned in such a way that a preload is maintained between each adjacent disk/spacer during engine operation. The preload is generated by compression washer 72, which is placed into a state of compression during the assembly of rotor 60 in a manner similar to that set forth above with respect to rotor 26. Faces 76 and 78, and channels 80 and 82, or more particularly, faces 84 and 86, are positioned so that compression washer 72 is in a state of compression between faces 76 and 78 when retaining ring 74 is positioned in both of channels 80 and 82, or more particularly, when retaining ring 74 is positioned between faces 84 and 86. The assembly and disassembly of rotor 60 may be performed similarly to that described above with respect to the embodiment of FIGS. 2-5. Torque may be transmitted between each disk/spacer by means (not shown), such as splines, pins or keys, for example.

In addition to the above, embodiments of the present invention include similar systems having compression washers, retaining rings, and two groups of two opposing faces that may be used to assemble static components, such as engine case structures, without the use of threaded joints or threaded fasteners.

Embodiments of the present invention include a gas turbine engine, comprising: a main engine rotor having a first rotor component and a second rotor component, wherein the first rotor component includes a first face and a first channel; and wherein the second rotor component includes a second face and a second channel; a compression washer disposed between the first face and the second face, wherein the compression washer is operative to mechanically load the first face against the second face; and a retaining ring, wherein the first face, the first channel, the second face and the second channel are positioned so that the compression washer is in a state of compression between the first face and the second face when the retaining ring is positioned in both the first channel and the second channel; and wherein the retaining ring reacts the mechanical loading produced by the compression of the compression washer.

In a refinement, the main engine rotor includes a turbine rotor and a compressor rotor, and wherein the first rotor component is one of the turbine rotor and the compressor rotor.

In another refinement, the main engine rotor includes a shaft operative to transmit power from the turbine rotor to drive the compressor rotor, and wherein the second rotor component is the shaft.

In yet another refinement, the compressor rotor includes a plurality of compressor stages, and wherein the first rotor component is a first compressor stage and wherein the second rotor component is a second compressor stage.

In still another refinement, at least one of the first rotor component and the second rotor component includes an opening extending into the respective at least one of the first channel and the second channel.

In yet still another refinement, the opening is structured to admit a tool therein for displacement of the retaining ring.

In a further refinement, the engine includes a spring disposed in one of the first channel and the second channel, wherein the spring is positioned to place a spring load on the retaining ring.

In a yet further refinement, the spring is a circumferential wave washer.

Embodiments include a method for assembly and disassembly of a main engine rotor of a gas turbine engine, comprising: positioning a compression washer between at least one of a first face of a first rotor component of the main engine rotor and a second face of a second rotor component of the main engine rotor; positioning a retaining ring in one of a first groove of the first rotor component and a second groove of the second rotor component; assembling the first rotor component to the second rotor component; applying a clamp load to force the compression washer into a state of compression between the first face and the second face; and displacing the retaining ring so that the retaining ring is positioned in both the first groove and the second groove.

In a refinement, the method further includes releasing the clamp load, wherein the retaining ring reacts the compression of the compression washer and retains the first rotor component in assembly with the second rotor component.

In another refinement, the first rotor component is clamped to the second rotor component without the use of threads.

In yet another refinement, the method also includes disassembling the first rotor component from the second rotor component by repositioning the retaining ring from being in both the first groove and the second groove to being in the one of the first groove and the second groove, and removing the first rotor component from the second rotor component.

In still another refinement, the repositioning of the retaining ring includes inserting a tool into an opening in one of the first groove and the second groove, and applying force to the retaining ring using the tool to displace the retaining ring.

In yet still another refinement, the method includes positioning a spring in one of the first groove and the second groove, wherein the spring is positioned to place a spring load on the retaining ring.

In a further refinement, the main engine rotor includes a shaft operative to transmit power from a turbine rotor to drive a compressor rotor, and wherein one of the first rotor component and the second rotor component is the shaft.

In a yet further refinement, the main engine rotor includes a plurality of compressor stages, and wherein the first rotor component is one compressor stage and wherein the second rotor component is an other compressor stage.

In a still further refinement, the main engine rotor includes a compressor disk and a compressor spacer, and wherein the first rotor component is the disk and wherein the second rotor component is the spacer.

Embodiments of the present invention include a system, comprising: a first component having a first face and a second face; a second component having a third face and a fourth face, wherein the third face is opposite the first face, and wherein the fourth face is opposite the third face; a compression washer disposed between the first face and the third face, wherein the compression washer is operative to mechanically load the first face against the third face; and a retaining ring, wherein the first face, the second face, the third face and the fourth face are positioned so that the compression washer is in a state of compression between the first face and the third face when the retaining ring is positioned between the second face and the fourth face; and wherein the retaining ring reacts the mechanical loading produced by the compression of the compression washer.

Embodiments of the present invention include a gas turbine engine main engine rotor, comprising: a first rotor component; a second rotor component; and means for clamping the first rotor component to the second rotor component.

In a refinement, the means for clamping includes a compression washer and a split retaining ring that jointly clamp together the first rotor component and the second rotor component.

While the invention has been described in connection with what is presently considered to be the most practical and preferred embodiment, it is to be understood that the invention is not to be limited to the disclosed embodiment(s), but on the contrary, is intended to cover various modifications and equivalent arrangements included within the spirit and scope of the appended claims, which scope is to be accorded the broadest interpretation so as to encompass all such modifications and equivalent structures as permitted under the law. Furthermore it should be understood that while the use of the word preferable, preferably, or preferred in the description above indicates that feature so described may be more desirable, it nonetheless may not be necessary and any embodiment lacking the same may be contemplated as within the scope of the invention, that scope being defined by the claims that follow. In reading the claims it is intended that when words such as "a," "an," "at least one" and "at least a portion" are used, there is no intention to limit the claim to only one item unless specifically stated to the contrary in the claim. Further, when the language "at least a portion" and/or "a portion" is used the item may include a portion and/or the entire item unless specifically stated to the contrary.

What is claimed is:

1. A gas turbine engine, comprising:

a main engine rotor having a first rotor component and a second rotor component, wherein the first rotor component includes a first face and a first channel; and wherein the second rotor component includes a second face and a second channel;

a compression washer disposed between the first face and the second face, wherein the compression washer is operative to mechanically load the first face against the second face; and a retaining ring, wherein the first face, the first channel, the second face and the second channel are positioned so that the compression washer is in a state of compression between the first face and the second face when the retaining ring is positioned in both the first channel and the second channel; and wherein the retaining ring reacts the mechanical loading produced by the compression of the compression washer.

2. The gas turbine engine of claim 1, wherein the main engine rotor includes a turbine rotor and a compressor rotor, and wherein the first rotor component is one of the turbine rotor and the compressor rotor.

3. The gas turbine engine of claim 2, wherein the main engine rotor includes a shaft operative to transmit power from the turbine rotor to drive the compressor rotor, and wherein the second rotor component is the shaft.

4. The gas turbine engine of claim 2, wherein the compressor rotor includes a plurality of compressor stages, and wherein the first rotor component is a first compressor stage and wherein the second rotor component is a second compressor stage.

5. The gas turbine engine of claim 1, wherein at least one of the first rotor component and the second rotor component includes an opening extending into the respective at least one of the first channel and the second channel.

6. The gas turbine engine of claim 5, wherein the opening is structured to admit a tool therein for displacement of the retaining ring.

7. The gas turbine engine of claim 1, further comprising a spring disposed in one of the first channel and the second channel, wherein the spring is positioned to place a spring load on the retaining ring.

8. The gas turbine engine of claim 7, wherein the spring is a circumferential wave washer.

9. A method for assembly and disassembly of a main engine rotor of a gas turbine engine, comprising:

positioning a compression washer between at least one of a first face of a first rotor component of the main engine rotor and a second face of a second rotor component of the main engine rotor;

positioning a retaining ring in one of a first groove of the first rotor component and a second groove of the second rotor component;

assembling the first rotor component to the second rotor component;

applying a clamp load to force the compression washer into a state of compression between the first face and the second face; and displacing the retaining ring so that the retaining ring is positioned in both the first groove and the second groove.

10. The method of claim 9, further comprising releasing the clamp load, wherein the retaining ring reacts the compression of the compression washer and retains the first rotor component in assembly with the second rotor component.

11. The method of claim 10, further comprising disassembling the first rotor component from the second rotor component by repositioning the retaining ring from being in both the first groove and the second groove to being in the one of the first groove and the second groove, and removing the first rotor component from the second rotor component.

12. The method of claim 11, wherein the repositioning of the retaining ring includes inserting a tool into an opening in one of the first groove and the second groove, and applying force to the retaining ring using the tool to displace the retaining ring.

13. The method of claim 10, further comprising positioning a spring in one of the first groove and the second groove, wherein the spring is positioned to place a spring load on the retaining ring.

14. The method of claim 10, wherein the main engine rotor includes a shaft operative to transmit power from a turbine rotor to drive a compressor rotor, and wherein one of the first rotor component and the second rotor component is the shaft.

15. The method of claim 10, wherein the main engine rotor includes a plurality of compressor stages, and wherein the first rotor component is one compressor stage and wherein the second rotor component is another compressor stage.

16. The method of claim 10, wherein the main engine rotor includes a compressor disk and a compressor spacer, and wherein the first rotor component is the disk and wherein the second rotor component is the spacer.

17. The method of claim 9, wherein the first rotor component is clamped to the second rotor component without the use of threads.

18. A system for assembling components of a gas turbine engine, comprising:

a first component having a first face and a second face;

a second component having a third face and a fourth face, wherein the third face is opposite the first face, and wherein the fourth face is opposite the third face;

a compression washer disposed between the first face and the third face, wherein the compression washer is operative to mechanically load the first face against the third face; and a retaining ring, wherein the first face, the second face, the third face and the fourth face are positioned so that the compression washer is in a state of compression between the first face and the third face when the retaining ring is positioned between the second face and the fourth face; and wherein the retaining ring reacts the mechanical loading produced by the compression of the compression washer.

19. A gas turbine engine main engine rotor, comprising:

a first rotor component;

a second rotor component; and means for clamping the first rotor component to the second rotor component.

20. The gas turbine engine main engine rotor of claim 19, wherein the means for clamping includes a compression washer and a split retaining ring that jointly clamp together the first rotor component and the second rotor component.

* * * * *